US006948187B2

(12) United States Patent
Drake

(10) Patent No.: US 6,948,187 B2
(45) **Date of Patent: *Sep. 27, 2005**

(54) PROTECTIVE GARMENT

(75) Inventor: Rogers Drake, Charlotte, NC (US)

(73) Assignee: SF Investments, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/453,397

(22) Filed: Jun. 3, 2003

(65) Prior Publication Data

US 2003/0196256 A1 Oct. 23, 2003

Related U.S. Application Data

(63) Continuation of application No. 10/113,212, filed on Mar. 29, 2002, now Pat. No. 6,601,239.
(60) Provisional application No. 60/280,046, filed on Mar. 30, 2001.

(51) Int. Cl.[7] ..... A41D 13/04
(52) U.S. Cl. ..... 2/51; 2/48
(58) Field of Search ..... 2/46–48, 69, 51, 2/125, 268, 114–115, 87–88, 85, 93, 456–458, 463, 92, 16, 49.1, 49.4, 901, 913

(56) References Cited

U.S. PATENT DOCUMENTS

| | | | | |
|---|---|---|---|---|
| 415,837 | A | 11/1889 | Frisbee | |
| 1,193,545 | A | 8/1916 | Hart | |
| 2,177,543 | A | 10/1939 | Vecchi | |
| 2,669,726 | A | 2/1954 | Meisel | |
| 2,724,120 | A | 11/1955 | Bien | |
| 3,868,728 | A | 3/1975 | Krzewinski | |
| 3,953,893 | A | 5/1976 | Byrnes, Sr. | |
| 4,171,542 | A | 10/1979 | Cox et al. | |
| 4,214,320 | A | 7/1980 | Belkin | |
| 4,504,977 | A | 3/1985 | King et al. | |
| 4,586,196 | A | 5/1986 | White | |
| 4,610,915 | A | 9/1986 | Crenshaw et al. | |
| 4,991,232 | A | 2/1991 | Taylor | |
| 5,174,305 | A | 12/1992 | Childs | |
| 5,271,100 | A | 12/1993 | Holt | |
| 5,361,411 | A | 11/1994 | Bohn et al. | |
| 5,444,871 | A | 8/1995 | Lopez | |
| 5,461,724 | A | 10/1995 | Wiedner et al. | |
| 5,560,974 | A | 10/1996 | Langley | |
| 5,594,955 | A | 1/1997 | Sommers | |
| 5,673,433 | A | 10/1997 | Rothrum | |
| 5,705,251 | A | 1/1998 | Morman et al. | |
| 6,138,278 | A | 10/2000 | Taylor et al. | |
| 6,235,659 | B1 | 5/2001 | McAmish et al. | |
| 6,601,239 | B2 * | 8/2003 | Drake | 2/51 |

* cited by examiner

*Primary Examiner*—Tejash Patel
(74) *Attorney, Agent, or Firm*—Hunton & Williams

(57) ABSTRACT

A protective garment comprises a porous, breathable body portion and sleeves made of a nonwoven synthetic fabric. The sleeves and a front part of the body portion are covered at their outer surfaces by outer layers of plastic film. In one embodiment, a protective skirt of plastic film extends down below a lower edge of the body portion for covering parts of the wearer that extend below the body portion. The protective skirt can include perforations facilitating adjustment of a vertical extent of the skirt.

5 Claims, 2 Drawing Sheets

PROTECTIVE GARMENT

CROSS-REFERENCE TO RELATED APPLICATIONS

This application is a continuation of U.S. patent application Ser. No. 10/113,212 filed Mar. 29, 2002, now U.S. Pat. No. 6,601,239, which claimed the benefit of U.S. Provisional Application Patent Application No. 60/280,046, filed Mar. 30, 2001.

FIELD OF THE INVENTION

The invention relates to a protective garment providing a barrier between a wearer and materials with which the wearer may come in contact.

BACKGROUND OF THE INVENTION

Conventionally, workers in the meat-packing industry have worn a reusable cotton smock over their regular clothes, and then have donned a separate plastic apron to cover the front of the smock, and separate plastic sleeve covers slipped over the sleeves of the cotton smock to cover their arms. These items are worn to create a barrier between the worker and the meat with which the worker comes into contact. The cotton smock is laundered and sanitized and then packaged for reuse. To comply with applicable regulations, a given worker may require three or even more of such smocks in a single work shift because the regulations mandate donning a freshly sanitized smock after certain activities such as taking a coffee or lunch break. Thus, the laundering and sanitizing of the smocks entail a significant effort and expense.

Furthermore, there are increasingly stringent requirements for sanitation imposed by the Food and Drug Administration (FDA), and it has become increasingly difficult to meet those requirements with the cotton smocks, because of the difficulty of completely sanitizing the garments. Another disadvantage of the cotton smock is that it readily absorbs liquids. The combination of the cotton smock with plastic apron and sleeve covers also is relatively heavy and uncomfortable particularly in hot weather.

SUMMARY OF THE INVENTION

The present invention addresses the above needs by providing a protective garment that, in a preferred embodiment of the invention, can be made so inexpensively that it can be discarded after use, thereby obviating the problem associated with adequately sanitizing a reusable cotton smock. The garment provides essentially the same level of protection that the conventional cotton smock with plastic apron and sleeve covers provide, but is significantly lighter in weight.

The garment comprises a smock having a body portion and a pair of sleeves attached to the body portion. The body portion preferably wraps at least partially about the body and preferably is slit up the back and is factened in back to secure it. The garment preferably also includes a fastening arrangement such as a neck loop that slips over the head to assist in holding the garment in place. The body portion and sleeves are made of a material that is porous so that it is breathable, and is preferably very light in weight. Synthetic non-woven fabrics are preferred as the porous material. Preferably the porous material does not absorb liquids to a substantial degree.

A portion of the outer side of the body portion of the garment is covered by a body outer layer for enhancing the liquid-imperviousness of the body portion and for preventing direct contact between the porous material of the body portion and objects that the wearer may rub up against during use. Thus, for instance, in a food-processing application and when the porous material of the body portion is a non-woven fibrous material, the body outer layer prevents fibers from the non-woven material from being abraded and shed onto the food with which the wearer is working. The body outer layer in preferred embodiments comprises a polymer film such as polyethylene or the like.

The body outer layer preferably does not cover the entire outer surface of the body portion, but preferably only the front part that overlies the front of the worker's body. The body outer layer preferably is sized and positioned so that it covers the front of the body from about the shoulders down to just above the knees.

The sleeves of the garment are also covered by an outer layer for enhancing the liquid-imperviousness of the sleeves and for preventing direct contact between the porous material of the sleeves and objects that the wearer may rub up against during use. The sleeve outer layers may cover all or less than all of the surfaces of the sleeves. The sleeve outer layers preferably comprise a polymer film, such as polyethylene or the like.

The body and sleeve outer layers can be secured to the porous material of the garment in various ways. It is possible to adhere or otherwise affix the entire surface area of the outer layers to the underlying porous layer, such as by laminating the outer layers to the porous material. However, in preferred embodiments of the invention, the outer layers are attached to the porous material over less than the entire surface area therebetween. More particularly, the body outer layer covering the front of the body portion preferably is attached to the porous material only at edges of the body outer layer. The body outer layer can be attached at less than all of its edges (e.g., only along top and opposite side edges but not along the bottom edge), and can be attached along less than the full length of one or more of the edges (e.g., at spaced locations along the top and/or side and/or bottom edges). It is also possible to attach the body outer layer to the porous layer at discrete spots spaced over the surface of the body outer layer. Similarly, the outer layers covering the sleeves preferably are attached to the porous material over less than the entire surfaces of the outer layers, such as for example along the edges of the sleeve outer layers, along less than the full length of one or more edges, or even at discrete spots spaced over the surface of the sleeve outer layer. The attachment of the layers can be made in various ways, such as by stitching, gluing, thermal welding, ultrasonic welding, etc.

In another embodiment in accordance with the invention, the garment includes a protective skirt of polymer film extending down from the lower edge of the body portion to cover lower parts of the wearer's body. The skirt preferably includes one or more lines of weakness extending horizontally across it to enable a lower portion of the skirt to be torn off for adjusting the vertical extent of the skirt.

The garment thus provides a barrier tending to prevent contact between a worker and items with which he or she may come in contact, such as food in the case of a worker in a food-processing plant. The outer layers perform two functions. First, they provide additional protection against liquids penetrating through the garment to the worker's clothes or skin, beyond the protection that the inner porous layer provides. Second, the outer layers help prevent fibers that are shed from the inner porous layer from being deposited on food or other items with which the worker comes in contact. Without the outer layer, the porous layer would tend to abrade when rubbed against objects, and fibers from the layer could contaminate the food or other items to which the worker is exposed.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
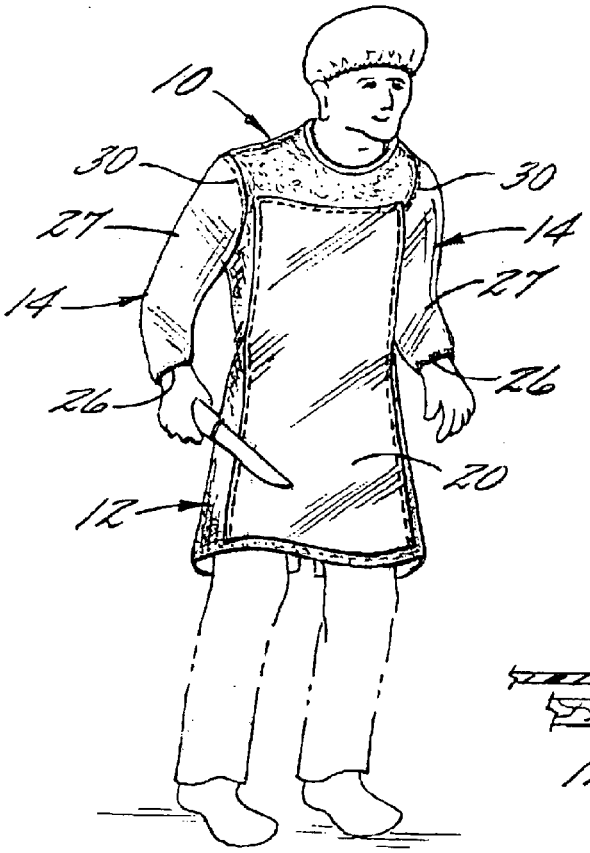
FIG. 1 is a perspective view showing a person wearing a garment in accordance with one embodiment of the invention.
Figure 2:
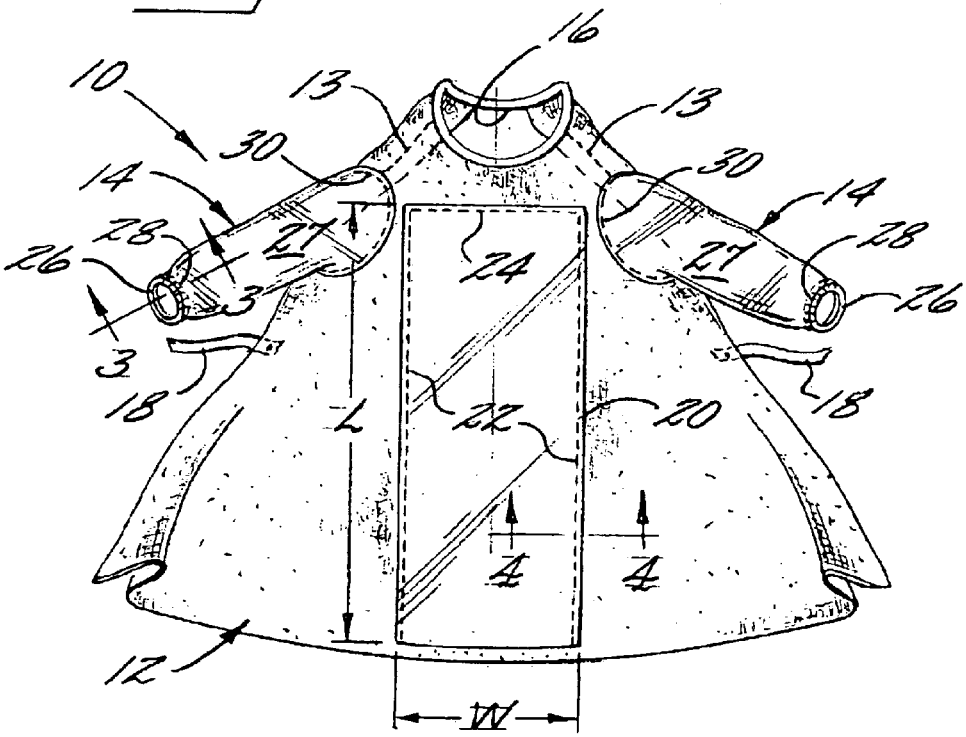
FIG. 2 shows a front view of the garment of FIG. 1 opened up into a generally flat configuration.

With reference to FIGS. 1 and 2, a protective garment 10 in accordance with one embodiment of the invention is shown. The garment 10 includes a body portion 12 that is sized to wrap about a person's body so that it covers at least the front and preferably also the sides of the body, and more preferably covers the front, sides, and back of the body. The height of the garment can vary depending on the intended use and the proportions and size of the wearer. Preferably, the garment is sized to extend from the shoulders to about the knees. The body portion 12 can include seams 13 extending generally along the top line of the wearer's shoulders for joining rear portions of the body portion 12 to a front portion thereof. A pair of sleeves 14 are attached to the body portion 12 for receiving the wearer's arms. Although the sleeves are shown as being long for covering substantially the entire arms down to the wrists, alternatively the sleeves could be short for covering less than the entire arms.

The body portion 12 and sleeves 14 are formed of a porous, breathable material. Examples of suitable materials include non-woven materials formed of synthetic fibers. A particularly preferred material is spunbonded non-woven polypropylene having a basis weight of about 35 g/m$^2$. However, non-woven fabric of other basis weights can be used instead, materials other than polypropylene can be used, and fabrics or materials other than non-woven fabrics can be used.

The garment 10 preferably also includes a neck loop 16 that extends around the back of the wearer's neck to help hold the garment in place. Alternatively, the neck loop 16 can be replaced by fasteners such as tie straps (not shown) or the like that can be engaged with each other around the back of the neck.

The body portion 12 preferably is slit in back (i.e., it is not continuous about the full circumference). A pair of fasteners such as tie straps 18 are attached to the opposite sides of the body portion 12 at about the waist level. The fasteners 18 are engaged with each other to secure the body portion about the body.

Where non-woven polypropylene is used for the body portion and sleeves, the non-woven material alone forms a relatively good barrier against penetration of liquids (e.g., blood or other fluids that may be present in a meat- or food-processing plant). However, the non-woven material tends to abrade or fray when rubbed against things that the wearer may be working with, and consequently fibers may be shed from the non-woven material. This is undesirable, particularly in the case of a food-processing plant where the food must be protected against contamination from the fibers.

Accordingly, the garment 10 includes additional outer layers both for enhancing the liquid-imperviousness of the porous material and for preventing direct contact between the porous material and items that the wearer may rub up against during use. The outer layers are provided only over selected regions of the garment. More particularly, the garment includes a body outer layer 20 disposed against the outward-facing surface of the body portion 12 and covering the part of the body portion that overlies the front of the wearer's body. For example, where the girth of the body portion is from about 100 to about 180 cm, a representative width W (measured in the girth direction) of the body outer layer 20 is about 50 to 80 cm, and a representative length L is about 60 to 90 cm, and a top edge of the shield 20 is located generally at or slightly below the shoulders. The dimensions of the body outer layer can be adapted to the size of the garment; for example, for a garment sized to fit a smaller person the body outer layer can be relatively smaller, whereas a garment sized to fit a larger person can have a relatively larger body outer layer.

Preferably, the body outer layer 20 is formed of a polymer film material. Examples of suitable materials include polyethylene, polypropylene, polyester, and the like. A particularly preferred material for the body outer layer comprises a polyethylene film having a thickness of about 0.025 mm, although plastic films of other thicknesses can be used instead.

The outer layer 20 need not necessarily comprise a plastic film, but could instead comprise a coating applied to the non-woven material of the body portion and/or sleeves.

However, to improve air circulation and hence the comfort of the wearer and to reduce the cost of manufacturing, the body outer layer 20 preferably comprises a plastic film and is not attached to the porous body portion 12 over the entire surface area of the body outer layer. Instead, the body outer layer 20 is attached to the body portion 12 only in selected areas, for example only along the perimeter of the body outer layer, and more preferably only along portions of the perimeter. Alternatively, the outer layer 20 can be secured in any suitable fashion to the porous layer of the body portion 12 at a plurality of spaced locations distributed over the surface of the outer layer 20.

Figure 4:
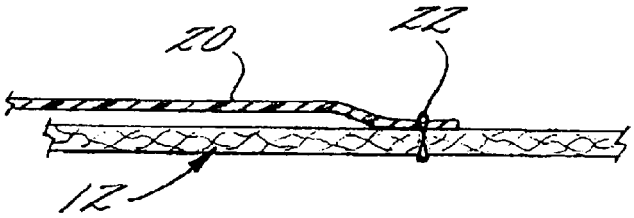
FIG. 4 is a cross-sectional view through a side seam between the outer plastic film layer and the body portion of the garment.

In a particularly preferred embodiment as shown in FIG. 1, the body outer layer 20 is attached to the body portion only in areas 22 at opposite vertical side edges of the body outer layer and in an area 24 extending along the top edge of the body outer layer. It is also possible to attach the body outer layer along only part of the top edge and/or along only part of each side edge. It is possible to attach the body outer layer at two or more spaced locations along the top edge and/or along each side edge. The lower edge of the body outer layer preferably is left unattached to the body portion, but alternatively could be attached. As shown in FIG. 4, by attaching the body outer layer 20 to the body portion of the garment at only the edges of the body outer layer, an open area is maintained between these two layers of the garment to facilitate air circulation through the garment; leaving the bottom edge of the body outer layer unattached further facilitates air circulation. The open area between the layers can also be provided by securing the outer layer 20 at spaced locations as previously described.

The size of the body outer layer 20 and the regions of the body portion 12 covered by it can be varied. In most cases a worker will tend to brush against objects with the front parts of his or her body, so it is generally desirable to position the body outer layer 20 to cover at least part of the front of the body portion 12 but to leave the rear parts of the body portion uncovered so as to facilitate air circulation through those parts.

The attachment between the body outer layer and the body portion can be effected in various ways, including stitching, gluing, ultrasonic welding, thermal welding, etc. Where thermal or ultrasonic welding are employed, the two layers should be compatible in terms of having about the same melting temperature, as known in the art. Where the two layers are not compatible such that thermal or ultrasonic welding is not possible or practical, alternative methods of attachment such as stitching or gluing are preferred.

Figure 3:
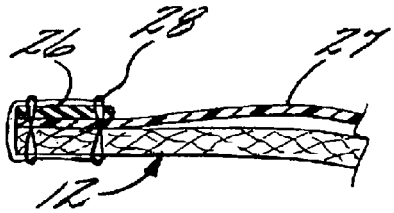
FIG. 3 is a cross-sectional view through one cuff of the garment of FIG. 2.

Each of the sleeves 14 of the garment is also covered by a sleeve outer layer 27, which can be formed of the same material as the body outer layer or of a different material. A preferred material for the sleeve outer layers 27 is polyethylene film having a thickness of about 0.025 mm, although films of other materials and/or thicknesses can be used instead, and the outer layer can comprise a coating rather than a film. The sleeve outer layers 27 preferably extend from the shoulders to the cuffs 26 of the sleeves. However, it is possible to cover only a portion of each sleeve with the outer layer 27; for instance, only a forward-facing side of the sleeve could be covered while leaving the rearward-facing portion uncovered. As another example, the sleeve outer layer 27 could cover less than the entire length of each sleeve (e.g., from the elbows down to the wrists). The sleeve outer layers 27 preferably are attached to the sleeves over less than the entire surfaces of the outer layers 27, such as in any of the manners previously discussed in connection with the body outer layer (i.e., attaching at edges of the outer layers, at spaced locations over the surfaces of the outer layers, etc.). Preferably, the sleeve outer layers 27 are attached only at the upper and lower ends of the layers 27, i.e., along areas 28 at the cuffs and along areas 30 at the shoulders, such as by stitching, gluing, welding, etc. Advantageously, the layers 27 are stitched at the cuffs 26 during a process of forming elasticized cuffs; alternatively, the cuffs can be non-elasticized. By attaching the sleeve outer layers 27 only at selected areas, an open area is maintained between the layers of the sleeves as shown in FIG. 3, such that air circulation is facilitated through the sleeves.

Figure 5:
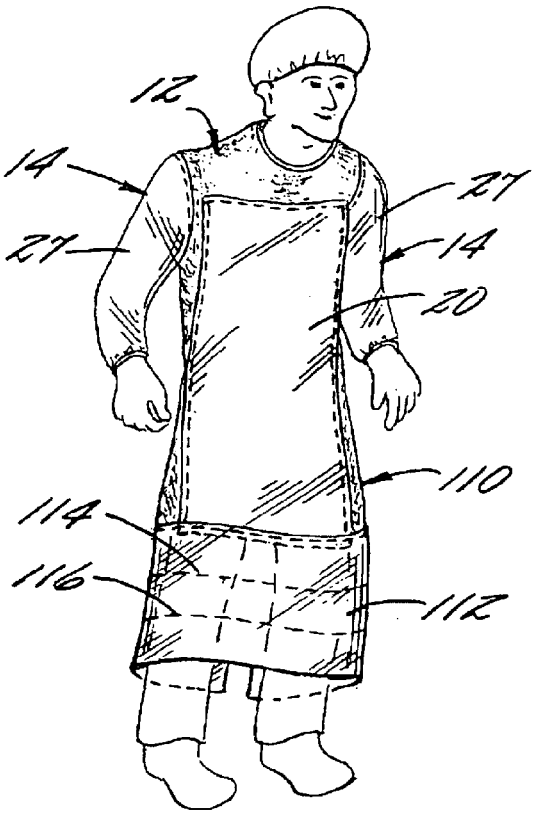
FIG. 5 depicts a garment in accordance with another embodiment of the invention.
Figure 7:
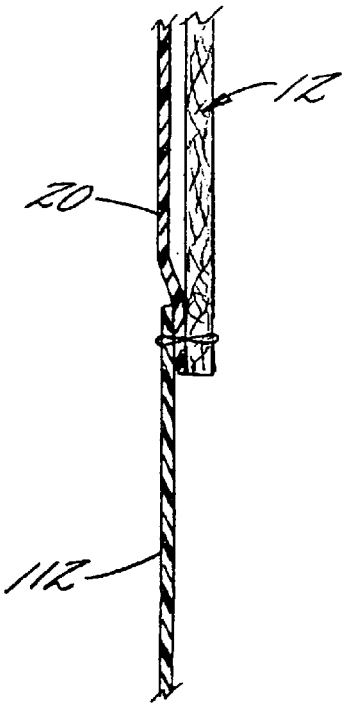
FIG. 7 is a cross-sectional view taken on line 7—7 of FIG. 6.
Figure 6:
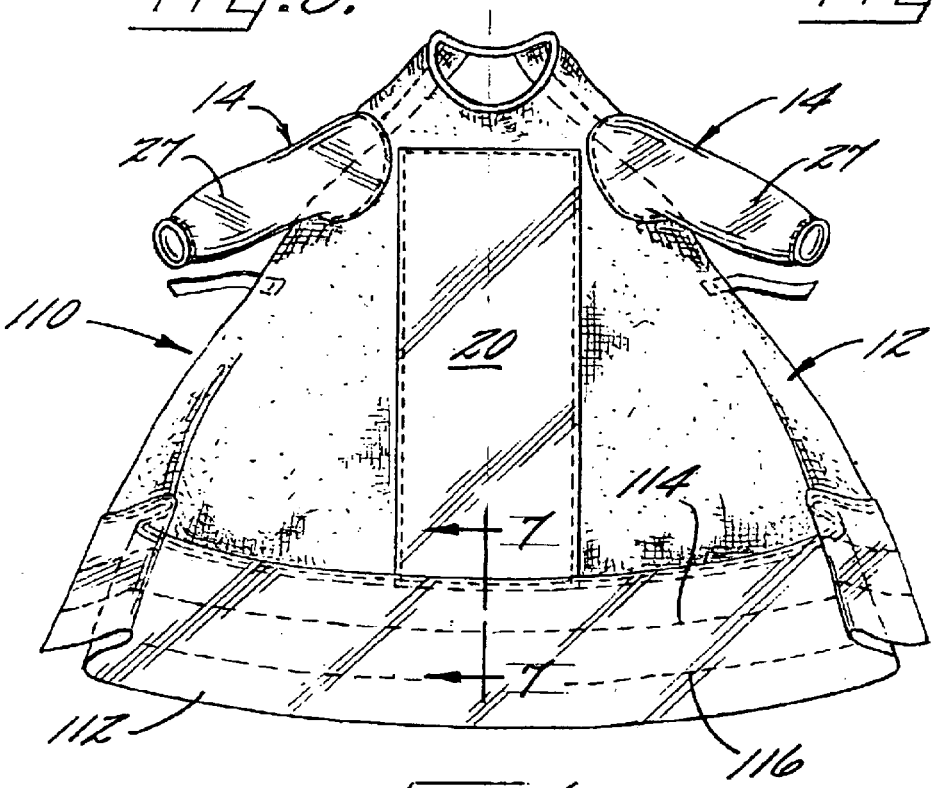
FIG. 6 is a front view of the garment of FIG. 5 opened up into a generally flat configuration.

FIGS. 5 through 7 depict another embodiment of the invention. The garment 110 of this embodiment includes a protective skirt 112 of liquid-impervious material extending down below the lower edge of the body portion 12 for protecting lower parts of the wearer's body below the body portion. The skirt 112 can be formed of any suitable liquid-impervious material, but preferably is formed of a polymer film such as polyethylene, polypropylene, polyester, or the like. The skirt 112 preferably is generally rectangular and has an upper edge that is attached (by stitching, gluing, thermal welding, ultrasonic bonding, etc.) to the body portion 12 adjacent the lower edge thereof. The upper edge of the skirt can also be attached to the body outer layer 20. It is also possible for the skirt 112 to be formed as an integral extension of the body outer layer 20 such that the body outer layer and skirt are a single piece of film. The horizontal width of the skirt (i.e., in the girth direction of the body portion) can be equal to or greater than the width of the body outer layer 20, and preferably is about equal to the width of the body portion 12.

The skirt 12 preferably includes at least one line of weakness extending horizontally therealong so that a lower portion of the skirt can be torn off to adjust the vertical extent of the skirt. In the preferred embodiment illustrated in FIG. 5, the skirt includes two such lines of weakness 114 and 116 spaced vertically apart. Accordingly, the skirt can be shortened by a small amount by tearing off the portion below the lower line 116, or can be shortened by a greater amount by tearing off the portion below the upper line 114. The line(s) of weakness can be formed by perforations or any other suitable technique.

The skirt 112 can be used in conjunction with a garment having the body outer layer 20 and sleeve outer layers 27 as shown in FIGS. 5–7. Alternatively, however, the skirt 112 can be used with other smock-like garments that may not include some or all of such outer layers.

The garment in accordance with the invention provides several advantages. The garment provides a sufficient barrier between the worker and the meat or other products with which he or she is working, yet is relatively inexpensive and simple to make, and thus can be disposed of rather than reusing it. Accordingly, no laundering is necessary. The garment can be made to easily meet FDA sanitary requirements, and in fact exceeds current requirements, thus preventing the spread of bacteria. The garment has sufficient strength and integrity to withstand normal usage, but if inadvertently caught in mechanical machinery such as a conveyor belt or gear, the garment will tear away, thereby reducing potential harm to the wearer. In contrast, conventional reusable cotton smocks and plastic aprons are quite strong and will not tear away very readily.

Although the garment has been discussed in connection with meat-processing, the garment may also be advantageous in other applications where sanitation, impermeability, and/or breathability are desirable characteristics of a protective garment. Such applications may include poultry-processing, fish-processing, other food-processing and packaging uses, and medical applications.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A protective garment providing a barrier between a wearer and materials with which the wearer may come in contact, comprising:

a body portion comprising a layer of nonwoven fabric configured to wrap at least partially about the body of the wearer;

a pair of sleeves each constructed of a layer of nonwoven fabric and attached to the body portion for receiving the wearer's arms;

a sleeve outer layer of polymer film covering at least a portion of an outer surface of each sleeve and attached to the sleeve; and a body outer layer of liquid-impervious material disposed on an outer surface of a front portion of the body portion and attached to the body portion.

2. The protective garment of claim 1, wherein the body outer layer is a layer of polymer film attached to the body portion in a manner providing open space between the polymer film and the nonwoven fabric so as to facilitate air circulation therebetween.

3. The protective garment of claim 1, wherein the body outer layer is attached to the body portion at discrete spaced locations.

4. The protective garment of claim 1, wherein the sleeves and body portion each comprise a single layer of the nonwoven fabric.

5. The protective garment of claim 1, wherein the sleeve outer layers are attached to the sleeves at discrete spaced locations.

* * * * *